US007845094B1

(12) United States Patent
Gaskins, Jr.

(10) Patent No.: US 7,845,094 B1
(45) Date of Patent: Dec. 7, 2010

(54) ICE GRIPPING ATTACHMENTS FOR FOOTWEAR

(76) Inventor: Thomas Gaskins, Jr., 1073 Council Rd., Venus, FL (US) 33960

( * ) Notice: Subject to any disclaimer, the term of this patent is extended or adjusted under 35 U.S.C. 154(b) by 0 days.

(21) Appl. No.: 12/322,198

(22) Filed: Jan. 30, 2009

Related U.S. Application Data

(60) Provisional application No. 61/062,894, filed on Jan. 30, 2008.

(51) Int. Cl.
*A43B 15/00* (2006.01)

(52) U.S. Cl. ..... 36/7.6; 36/11.5

(58) Field of Classification Search ..... 36/7.6, 36/11.5, 9 R, 59 R, 62, 59 C, 9 A
See application file for complete search history.

(56) References Cited

U.S. PATENT DOCUMENTS 1,187,778 A * 6/1916 Paskett ..... 36/7.5
1,769,328 A * 7/1930 Auster ..... 36/11.5
1,773,127 A * 8/1930 Auster ..... 36/11.5
1,805,728 A * 5/1931 Sohn ..... 36/11.5
2,803,894 A * 8/1957 Morgan ..... 36/11.5
3,002,297 A * 10/1961 Neilson ..... 36/11.5
3,021,617 A * 2/1962 Koch ..... 36/7.6
3,027,658 A * 4/1962 Rigsby ..... 36/97
3,057,085 A * 10/1962 Rigsby ..... 36/97
5,038,500 A * 8/1991 Nicholson ..... 36/59 C
6,848,202 B2 * 2/2005 Berggren ..... 36/97
2002/0078598 A1 * 6/2002 Bell ..... 36/59 R
2006/0101667 A1 * 5/2006 Kane ..... 36/9 R

* cited by examiner

*Primary Examiner*—Marie Patterson
(74) *Attorney, Agent, or Firm*—William E. Noonan

(57) ABSTRACT

An ice gripping footwear attachment includes a base having an upper surface for engaging the bottom of the footwear and a lower surface carrying a grit material that is frictionally engagable with an ice covered surface. Forward, intermediate and rearward fastening straps are secured to the base. The forward strap is wrapped across the footwear such that it extends rearwardly in a crisscrossed pattern. The intermediate strap is wrapped and fastened over the forward strap. The rearward strap is then secured across the wearer's ankle or heel to securely fasten the attachment to the footwear.

19 Claims, 4 Drawing Sheets

ICE GRIPPING ATTACHMENTS FOR FOOTWEAR

RELATED APPLICATION

This application claims the benefit of U.S. Provisional Patent Application Ser. No. 61/062,894 filed Jan. 30, 2008.

FIELD OF THE INVENTION

This invention relates to ice gripping attachments that are worn on a person's footwear to help the person avoid slipping on an icy surface.

BACKGROUND OF THE INVENTION

Subfreezing weather conditions often produce icy and extremely slippery walking surfaces. This presents a serious risk of slips, falls and resulting injuries. Indeed, each winter numerous persons suffer broken bones and other forms of injury as a result of slipping and falling on ice covered walking surfaces. Notwithstanding previous efforts to address this danger, slick icy walking conditions remain a constant and annoying problem associated with winter weather and subfreezing temperatures.

A wide variety of footwear attachments have been provided utilizing cleats, spikes and other features designed to improve the wearer's traction on icy and slippery surfaces. These products tend to be fairly awkward to wear and are often impractical and ineffective to utilize on streets, sidewalks, residential walkways, driveways and similar environments. Many of the prior devices are more appropriately suited for mountain camping, wilderness, hiking and/or climbing applications. By the same token, many of the known anti-slip footwear attachments impede the wearer's movement and/or maneuverability. The wearer tends to get "stuck" in the ice; walking is apt to be annoying and frustrating.

Rohde, U.S. Pat. No. 5,485,687 and Harrison, U.S. Pat. No. 6,055,748 have utilized devices featuring a sandpaper or grit material that is applied to the sole of a shoe for improving traction on ice and snow. However, these devices likewise have a number of shortcomings. Both tend to leave significant portions of the shoe sole exposed, which continues to present a serious risk of slipping. The Harrison devices are secured by an adhesive, which is likely to deteriorate and fail, particularly when the footwear is worn in harsh weather conditions. The Rohde device utilizes a Velcro® strap. However, the particular form of attachment featured by that reference is insecure at best. As the wearer walks over snow and ice, the gripping surface, and indeed the entire anti-slip attachment is apt to slide or move along the wearer's shoe. There is even a real possibility that the Rohde traction attachment will slip completely off of the wearer's shoe! In either case, movement of the attachment relative to the footwear increases the possibility that the wearer will experience a nasty slip and fall. Much more snug and secure means for attaching an anti-slip device to various forms of footwear are required.

SUMMARY OF THE INVENTION

It is therefore an object of the present invention to provide a significantly improved ice gripping footwear attachments that reduce the risk that the wearer will slip and fall on an icy walking surface and therefore makes walking on such surfaces much safer.

It is a further object of this invention to provide a device that reduces a person's risk of suffering a serious injury when walking across an icy or frozen surface.

It is a further object of this invention to provide an ice gripping footwear attachment carrying substantially the entire sole of the footwear with a slip resistant grit surface to more effectively grip the underlying ice while not interfering with the user's walking or maneuverability.

It is a further object of this invention to provide ice gripping footwear attachments that allow the wearer to walk over frozen and icy surfaces much more easily and less ponderlessly than is permitted by conventional anti-slip footwear attachments.

It is a further object of this invention to provide ice gripping footwear attachments that snugly and securely fasten to the wearer's shoes and which resist slipping or moving relative to the shoes during use so that much safer walking is enabled.

It is a further object of this invention to provide ice gripping footwear attachments featuring straps that are secured in place and resist movement during use so that wearer safety is improved.

It is a further object of this invention to provide ice gripping footwear attachments that may be utilized for virtually any size, shape or variety of men's or women's footwear (i.e. shoes, boots).

It is a further object of this invention to provide ice gripping footwear attachment featuring a reliable ice engaging grit surface that covers not only the sole and the heel but also the back of the footwear to provide for traction that is significantly improved over conventional devices.

This invention features an ice gripping footwear attachment having a sole engaging base. The base includes an upper surface for engaging the sole of a wearer's footwear and a lower surface carrying a grit material that is frictionally engagable with an underlying ice covered or otherwise icy walking surface. A forward portion of the base carries a forward fastening strap that extends transversely to and outwardly from opposite sides of the base. An intermediate section of the base carries an intermediate fastening strap that extends transversely to and outwardly from the opposite sides of the base. The straps are joined to the base by adhesive and/or reinforcing grommets, rivets or other forms of attachment. The forward strap includes first and second parts that respectively carry complementary hook and loop (Velcro®) connectors. The first and second parts of the forward strap are wrapped about the wearer's footwear and the complementary hook and loop connectors are interengaged to secure the forward strap to the footwear. Similarly, the intermediate strap includes first and second segments that respectively carry complementary hook and loop connectors. These segments are likewise wrapped about the footwear and the complementary hook and loop connectors are interengaged to fasten the intermediate strap to the footwear. A rearward portion of the base carries an ankle engaging connector that is releasably engaged with the wearer's ankle. When the forward and intermediate straps are fastened to the footwear and the ankle engaging connector is engaged with the wearer's ankle, the ice gripping attachment is securely attached to the footwear and the grit on the lower surface of the base is frictionally engagable with ice on an underlying walking surface.

In a preferred embodiment, the forward end of the base includes a trapezoidal configuration and the forward fastening strap is secured and extends transversely to the trapezoidal forward section of the base such that when the forward strap is wrapped about the footwear, the first and second segments of the forward strap extend generally rearwardly from the forward portion of the base to form an X-shaped pattern across the footwear. The intermediate portion of the base may have substantially parallel sides and the intermediate strap may be secured to the intermediate portion of the base such that when the intermediate strap is wrapped about the footwear the first and second strap segments of the intermediate strap encircle the footwear in a substantially cylindrical configuration. The intermediate strap may be wrapped across and interengage the crossing forward strap segments when the intermediate strap segments are interengaged with one another.

The rearward portion of the base may include a horizontal part for engaging a bottom of the heel of the footwear. A generally vertical part may be attached to and extend upwardly from the horizontal part. The horizontal and vertical parts may be interconnected along a transverse fold line. The vertical part of the rearward portion may include a heel-engaging piece. The heel-engaging piece may extend exteriorly across the back of the footwear. A generally gable-shaped opening may be formed in the vertical part for accommodating at least a portion of the heel of the footwear. Ice engaging grit may be carried by substantially the entire bottom surface of the base, including both the horizontal and vertical parts of the rearward portion of the base.

The ankle engaging connector may include a rearward fastening strap that extends transversely to and outwardly from the opposite sides of the rearward portion of the base. The rearward fastening strap may include a first segment that extends from one side of the vertical part of the rearward portion of the base and a second segment that extends from the other side of the vertical part. Each of these segments may include a complementary hook and loop connector. The rearward fastening strap is releasably connected to an ankle of the wearer by wrapping the first and second parts about the wearer's ankle and interengaging the complementary hook and loop connectors carried thereby. The rearward fastening strap may include notches that interengage complementary holes in the vertical part of the rearward portion of the base. This holds the fastening strap in place so that it does not longitudinally slide relative to the rearward portion of the base.

The forward and intermediate fastening straps may be adhesively secured to the upper surface of the base. One or more grommets may be utilized to strengthen the interconnection between the forward and intermediate fastening straps and the base. By the same token, one or more grommets may be utilized to strengthen the interconnection between the rearward strap and the base.

In alternative embodiments, the rearward strap may include a pair of first and second strap segments that are longitudinally juxtaposed in a side-by-side manner and that extend rearwardly from a rearward end portion of the base. In such cases, the first and second strap segments of the rearward strap may be formed by attaching a single piece of strap material to the rearward portion of the base such that it extends longitudinally rearwardly from the base. This material is then cut longitudinally to form a pair of side-by-side segments. Adhesives and/or grommets may be utilized to secure the segments to the rearward portion of the base. The segments are manipulated and wrapped about the wearer's ankle to secure a rearward portion of the base to the footwear.

The base is typically flat. The grit material preferably includes zirconia. Alternatively, ceramic grit may be employed.

DETAILED DESCRIPTION OF PREFERRED EMBODIMENTS

Other objects, features and advantages will occur from the following description of a preferred embodiment and the accompanying drawings, in which.

Figure 1:
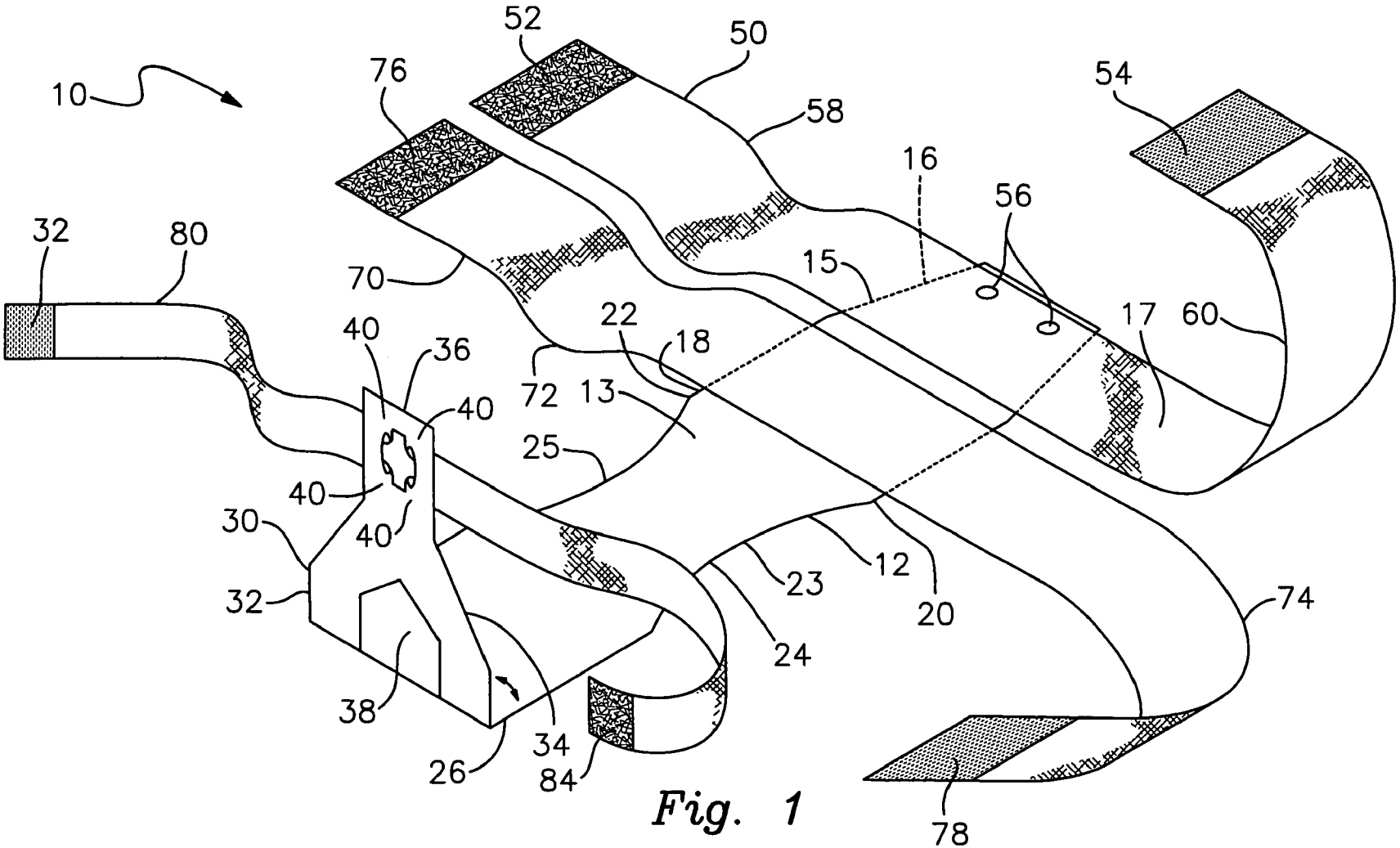
FIG. 1 is a perspective view of a preferred, full coverage ice gripping footwear attachment in accordance with this invention; this version is designed to cover substantially the entire bottom surface (sole and heel), as well as the back of the footwear.
Figure 2:
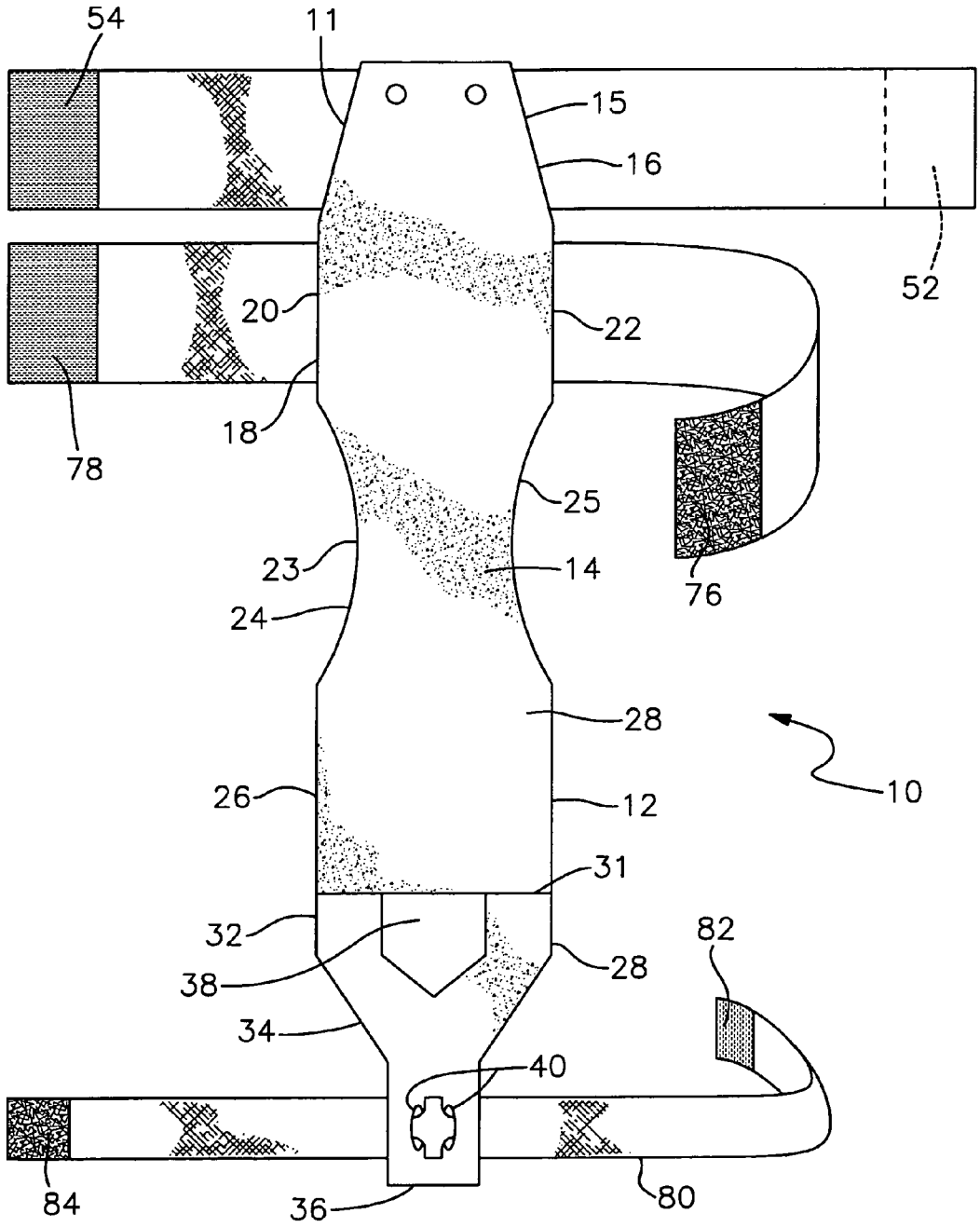
FIG. 2 is a bottom plan view of the attachment of FIG. 1.

There is shown in FIGS. 1 and 2 an ice gripping footwear attachment 10 for improving the traction of a wearer walking across a slippery icy surface. Each of the figures discloses a single attachment. It should be understood that such an attachment is employed for each of the wearer's shoes. A wearer normally utilizes a pair of attachments, each for being worn by a respective shoe of other piece of footwear. Typically, each attachment has an identical configuration (i.e. each attachment 10 may by utilized with either the right shoe or the left shoe of the wearer). It should also be understood that attachment 10 may be employed in a wide variety of environments and applications where improved ice gripping and traction are desired. This may include, for example, outdoor use in winter, stormy and/or cold weather conditions. The attachments may be worn on shoes, boots, athletic footwear and virtually any other types of footwear. By the same token, attachment 10 may also be utilized by workers and other persons requiring improved traction on ice rinks, frozen ponds and other man-made or natural ice covered environments. The particular application in which the attachment is used is not a limitation of this invention. Attachment 10 may be marketed under the trademark ICE GRIPPER™ or other brand names.

Attachment 10 includes an elongate end generally flat base 12 composed of a durable yet flexible material such as rubber or plastic having an upper surface 13 and a lower surface 14. The thickness of the base may vary in accordance with this invention. The base comprises a single piece of material and bottom surface 14 carries an extremely hard and frictionally effective grit material. Zirconia is particularly preferred. Ceramic may also be utilized. In particularly preferred versions, the base may be composed partially or entirely by a durable and extremely heavy duty material such as polyester sheeting carrying a grit material 114 on lower side 14. Grit material 114 is epoxied to, embedded in or otherwise applied to the base.

Base 12 includes a generally trapezoidally shaped forward or toe section 16 having angled sides 15 and 17 and a rearwardly adjacent intermediate section 18 having parallel sides 20 and 22. In use, forward section 16 is positioned generally beneath the toe of the wearer's foot. Intermediate section is positioned generally beneath the ball of the foot. Typically, the angled sides 15 and 17 form respective angles of approximately 22½° with a longitudinal axis of base 12. Other angular configurations may be formed by sides 15 and 17 within the scope of this invention.

An arch section 24 is uniformly joined to intermediate section 18. Arch section 24 includes a pair of recesses 23 and 25 formed along respective sides of the base. In alternative embodiments, these recesses may be eliminated and the sides of the arched section may comprise parallel continuations of sides 20 and 22.

Base 12 includes a rearward section 26 immediately adjacent and joined in one piece to arch section 24. Rearward section 26 is designed for engaging the bottom and back of the heel of the footwear to which attachment 10 is fastened. More particularly, rearward section 26 includes a horizontal part 28 that is engagable with the bottom of the wearer's heel and a vertical part 30 that is unitarily attached to and extends upwardly from part 28 for engaging the back of the wearer's heel. Parts 26 and 28 are foldably connected along fold line 31. Vertical part 28 includes a lower end portion 32 having generally parallel sides, a converging portion 34 having inwardly tapered sides and an upper tab 36 that extends upwardly from converging portion 34.

A gable shaped aperture or opening 38 is formed in vertical part 30 of rearward portion 26. This aperture accommodates the heel of the footwear in a manner that is described more fully below. By the same token, a pair of generally oval holes 40 are formed in tab 36 for accommodating a rearward fastening strap in a manner that is described more fully below. These oval holes may have a dimension of ¾" long by ¼" wide, although alternative dimensions may be employed within the scope of this invention.

Typically, forward section 16, intermediate section 20, arch section 23 and both horizontal part 28 and vertical part 32 of rearward section 26 comprise a single piece of substantially flat, flexible material. In alternative embodiments, the sections of the base may be joined together using various manufacturing techniques. It is important that the zirconia or other grit material be formed over the entire bottom surface 14 of the base. The base may have a length of approximately 17½" and a width of approximately 4". This should be adequate to cover the sole of most large sizes of footwear. These dimensions may be varied within the scope of this invention.

A forward fastening strap 50 is adhered to and carried by forward section 16 of base 12. Strap 50 includes an elongate piece of flexible, yet durable strap material that extends transversely to section 16 and across the upper surface 13 of base 12. Strap 50 may be composed of various rugged strap materials and in certain preferred embodiments may include a two-sided hook and loop construction, which features, for example, a loop material 52 on one side and a hook material 54 on the opposite side. Typically, strap 50 is joined to the upper surface 13 of base 12 by a durable and weather resistant adhesive. The connection may be strengthened by securing strap 50 to base 12 by grommets 56 (FIG. 1). Rivets and other forms of reinforcing attachment may also be utilized. In either case, strap 50 extends transversely to base 12 such that a first segment 58 of strap 50 extends outwardly from angled side 15 and a second segment 60 of the fastening strap extends outwardly from angled side 17 of forward section 16.

An intermediate fastening strap 70 is similarly secured to intermediate section 18 of base 12. In particular, elongate strap 70 extends transversely to intermediate section 18 and is adhesively or otherwise fastened to the upper surface 13 of the base. Once again, grommets or rivets (not shown) may be used to strengthen this connection. Strap 70 extends across intermediate section 18 such that the first strap segment 72 extends from side 22 and a second strap segment 74 extends from side 20. It should be noted that, in alternative embodiments, the individual forward and intermediate strap segments 58, 60, and 72, 74 respectively may be separate and distinct from one another and separately connected to the base rather than being formed by continuous straps as shown herein. Various forms of stitching, adhesive, grommets, rivets and other means of connection may be utilized to securely join the forward and intermediate fastening straps to the base.

Intermediate strap 70 likewise includes complementary hook and loop (Velcro®) forms of connection that allow the strap segments 72 and 74 to be releasably interengaged with one another. For example, the outwardly facing surface of strap segment 72 includes a loop material 76 and the underlying surface of strap segment 74 includes a hook component 78. In certain embodiments, strap 70 may be composed of an upwardly facing strip of loop material 76 and a downwardly strip of hook material 78 that are laminated or fused together in a conventional manner. Indeed, each of straps employed by attachment 10 may be constructed in this manner. Typically, the forward and intermediate straps have overall lengths of 16" apiece.

Figure 2A:
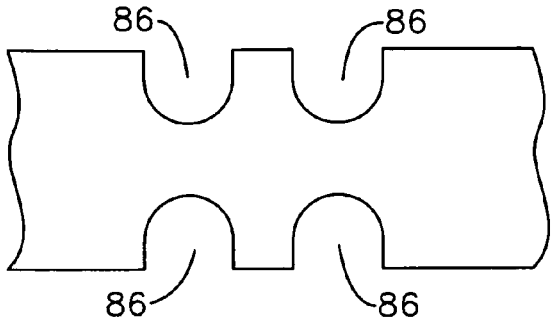
FIG. 2A is a fragmentary view of a section of the rear strap featuring the notch engaging recesses.

A rearward, ankle engaging fastening strap 80 is carried by tab 36 of rearward base portion 26. Strap 80 is composed in a manner analogous to that of the forward and intermediate fastening straps 50 and 70. Typically, rearward strap 80 is somewhat narrower than the forward and intermediate fastening straps. Complementary hook and loop connectors, namely hook material 82 and loop material 84, are formed on respective sides and/or at respective ends of strap 80. The strap also includes four intermediate notches 86, FIGS. 2, 2A, that interengage with oval holes 40 in tab 36. This holds strap 80 longitudinally in place so that it remains in place secured about the wearer's ankle. Strap 80 may be constructed in a manner analogously to straps 50 and 70.

Figure 3:
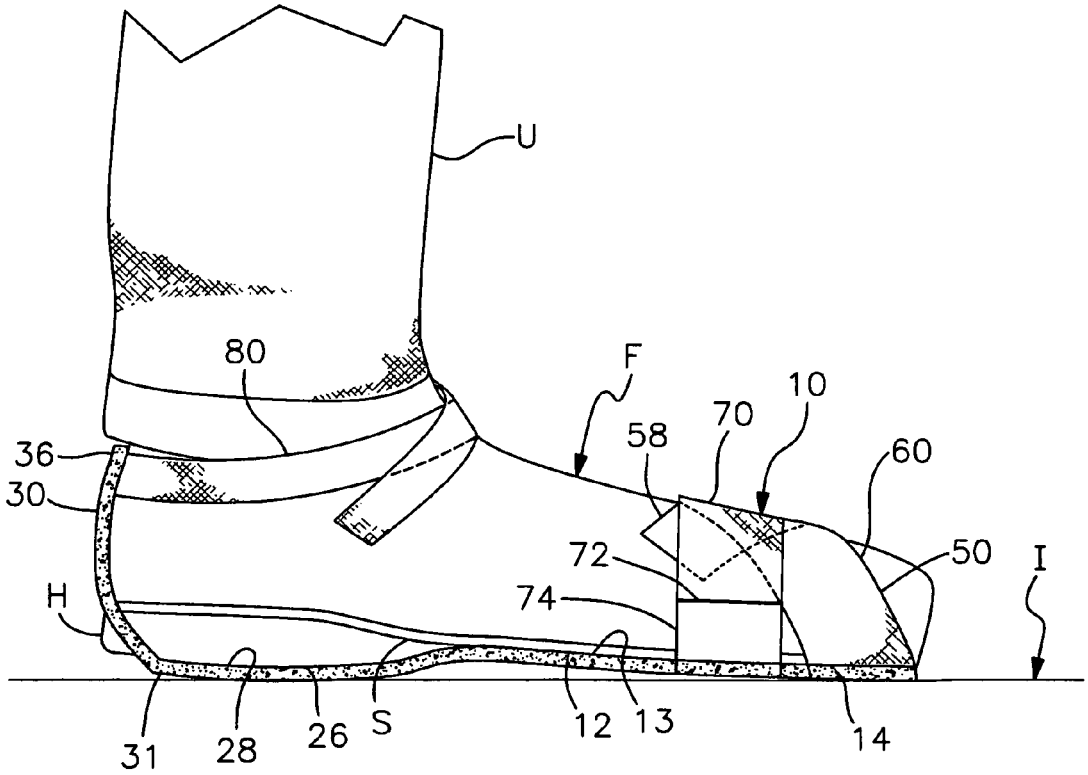
FIG. 3 is a side elevational view of the attachment of FIGS. 1 and 2 as engaged with the footwear of a wearer walking across an icy surface.

Attachment 10 is fastened to a person's footwear and used to improve traction on an icy surface in the manner shown in FIG. 3. Prior to encountering an icy walking surface I, user U fastens attachment 10 to each piece of footwear F in the following manner. Initially, each attachment 10 is opened in the manner shown in FIGS. 1 and 2. User U engages the sole S of footwear F against upper surface 13 of base 12. The user then wraps segments 58 and 60 of strap 50 over footwear F and interengages those strap segments in an X-shaped configuration. Loop connector 52 (FIGS. 1 and 2) is releasably interengaged with hook connector 54 so that strap segments 58 and 60 are held together in a crossing or X-shaped configuration over the shoe. See FIG. 3. This crossing pattern is achieved because when the strap segments 58 and 60 are extended and wrapped across the shoe, the angled sides 15 and 17 of forward base portion 15 (see FIG. 1) cause the strap segments to extend rearwardly as they cross over the shoe. See FIG. 3. User U then wraps transverse strap segments 72 and 74 of intermediate strap 70 across footwear F. In particular, strap segments 72 and 74 are pulled over the crossing strap segments 58 and 60 in the generally cylindrical manner shown in FIG. 3. Loop connector 76 is releasably interengaged with hook connector 78 so that the fastened strap segments 72 and 74 are wrapped over and securely retain the underlying strap segments 58 and 60 (which are themselves already interengaged). As a result, a pair of overlapping fastened straps 50 and 70 hold the toe and ball areas of footwear F securely and snugly engaged with the underlying base 12 of attachment 10.

After the forward and intermediate straps 50 and 70 are fastened to footwear F, user U grasps tab 36 of rearward base portion 28 and pulls vertical part 30 of rearward portion 26 upwardly such that vertical portion 30 interengages the back of footwear F, in the manner shown in FIG. 3. The back end of heel H engages and protrudes slightly through aperture 38 (FIGS. 1 and 2) and rearward base portion 26 is essentially bent perpendicularly along fold line 31. The majority of heel H engages horizontal part 28 of rearward base portion 26.

User U next grasps the respective ends of rearward strap 80 and wraps the strap about his or her ankle in the manner shown in FIG. 3. The opposing segments 82,84 of strap 80 are crossed and interengaged in the manner shown in FIG. 3 such that hook connector 82 is releasably and lockably interengaged with loop connector 84. As is also the case with the forward and intermediate straps 50 and 70, the ankle engaging strap 80 may be adjusted (i.e. selectively tightened or loosened) by simply altering the locations at which the opposing strap segments interengage one another. This is done in a conventional manner as exhibited by various other hook and loop connecting straps.

When fasteners of all of the straps is completed, as in the manner shown in FIG. 3, attachment 10 is snugly and securely attached to footwear F. User U is now ready to walk over ice covered surface I in a safe, secure and reliable manner. Bottom grit surface 14 of base 12 frictionally engages the icy surface I and allows the user U to walk safely upon the icy surface without slipping. The zirconia grit material is extremely hard and enables attachment 10 to resist slipping over the ice. Zirconia is approximately 10 times harder than normal sandpaper and provides for a significantly improved grip with an underlying icy surface. At the same time, the grit material is omni directional so that slipping is prevented in virtually any direction. The grit surface continues along the bottom of vertical part 30 so that improved slip resistance is even provided for the back of footwear F. The unique and improved secure attachment provided by fastening straps 50, 70 and 80 prevents attachment 10 from sliding longitudinally or otherwise relative to footwear F. This further reduces the possibility that user U will stumble and slip on the ice, and greatly improves the safety of a person walking over a slick or icy surface.

The zirconia or alternative grit material on the lower surface of base 12 also improves the walker's maneuverability and ease of movement over icy surface I. Although the grit provides for improved frictional engagement with the underlying ice, it does not sink into or get otherwise caught or snagged in the ice. By utilizing the ICE GRIPPER™ attachment 10 in the foregoing manner on each foot, the user is able to walk deliberately and to change direction in the ice as required without being impeded by the grit surface 14.

Figure 4:
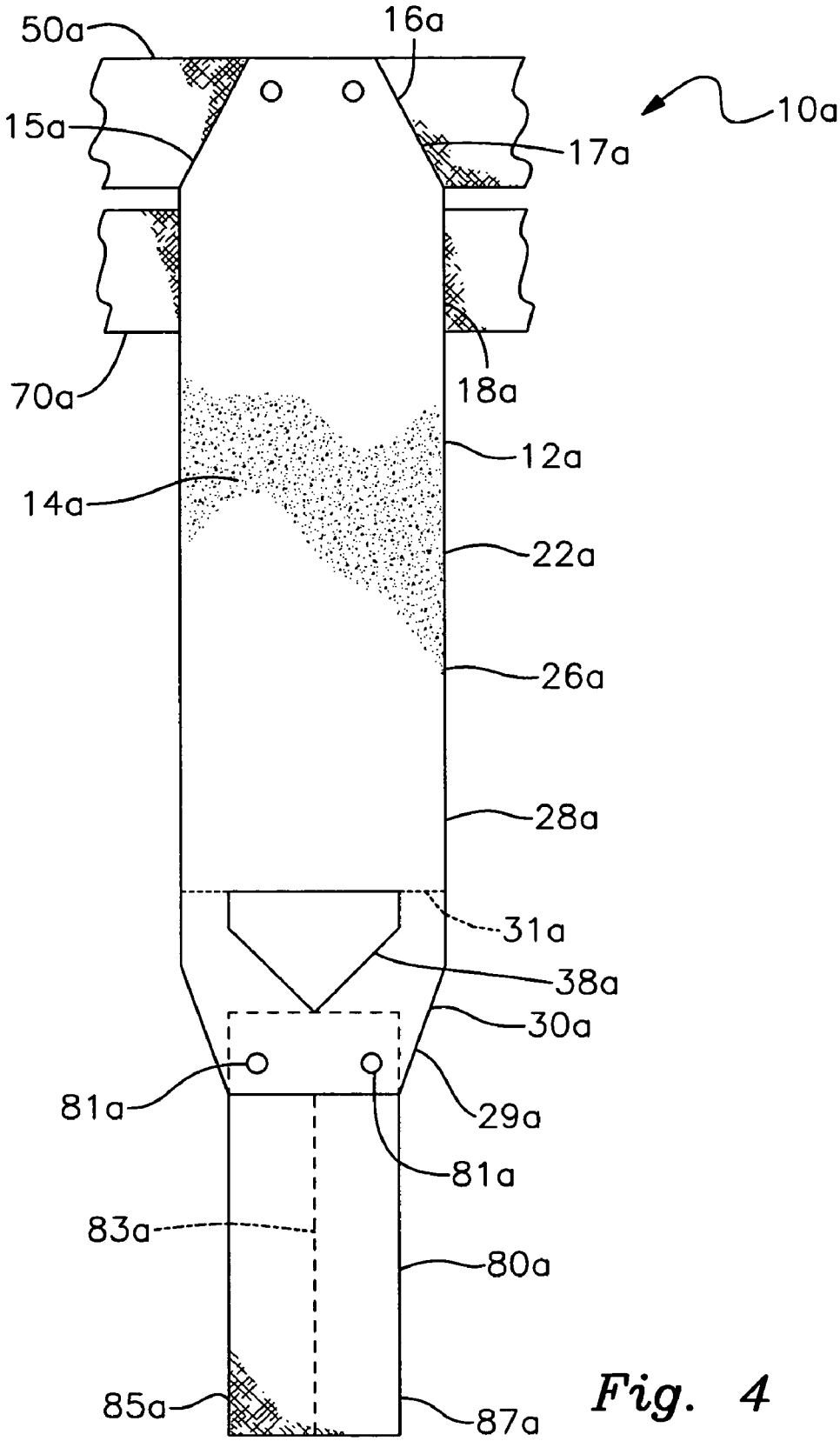
FIG. 4 is a top plan view of an alternative full coverage ice gripping footwear attachment.

An alternative attachment 10*a* is depicted in FIG. 4. This version features a base 12*a* that engages the bottom of the sole and heel of a shoe or other piece of footwear. Base 12*a* is composed of polyester sheeting or various other flexible, yet rugged and durable materials featuring zirconia or other forms of grit 14*a* exposed or otherwise attached to its bottom surface. Base 12*a* may comprise a flat, flexible material composed of, for example, a plastic or elastomeric substance that is flat and thin. The base includes a forward, trapezoidal section 16*a* having side edges 15*a* and 17*a* that are formed at an angle (e.g. 22½°) to the longitudinal axis of the base. The base also includes an intermediate section 18*a* that is unitarily connected to forward section 16*a*. A rearward section 26*a* is likewise unitarily connected to intermediate section 18*a*. Intermediate section 18*a* and rearward section 26*a* of base 12*a* have continuous, longitudinal, parallel sides 20*a* and 22*a*. Rearward portion 26*a* includes a horizontal part 28*a* and a vertical part 30*a* that is foldably interconnected to part 28*a* along fold line 31*a*. A gabled shaped cutout 38*a* is formed in part 30*a* adjacent to fold line 31*a*.

The foregoing components are constructed and operate analogously to the corresponding components disclosed in FIGS. 1-3. In this version, a somewhat different ankle connecting component is utilized. Specifically, an elongate Velcro® strap 80*a* is secured to vertical part 30*a* of base 12*a*. Grommets or rivets 81*a* are utilized to provide a strong interconnection between strap 80*a* and base 12*a*. A slit 83*a* is formed longitudinally in strap 80*a* to provide discrete strap segments 85*a* and 87*a*. Each of these strap segments carries a hook material fastening component on one side of the strap and a loop material fastening component of the opposite side of the surface of the strap. This allows the strap segments to be wrapped the wearer's ankle and releasably interengaged in a manner analogous to that previously described.

In operation, the attachment 10*a* is attached to the wearer's foot in a manner similar to that in the prior embodiment. The forward and intermediate straps, 50*a* and 70*a* are wrapped about the footwear and releasably secured. The user then pulls vertical part 30*a* upwardly against the back of his or her shoe such that the rearward heel of the shoe extends through cutout 38*a*. Straps segments 85*a* and 87*a* are then wrapped about the wearer's ankle to snugly and securely fasten the attachment 10*a* to the shoe. The benefits achieved in the previously described embodiment are likewise achieved in this version.

It should be understood that the configuration and dimensions employed by the various attachments of this invention may be varied within the scope of this invention. The drawings indicate representative dimensions that illustrative only and should not be considered limitative of the scope of the invention. It should also be understood that the hook and loop fasteners may be constructed in various known manners. The versions of FIGS. 1-4 advantageously provide for full grit coverage across both the sole and heel of the shoe. All versions of this invention provide for significantly improved Velcro® fastening technique wherein a forward strap is crisscrossed and secured beneath an overlying transverse Velcro® strap. This limits any slippage of the attachment relative to the footwear and thereby significantly improves traction, slip resistance and safety.

From the foregoing it may be seen that the apparatus of this invention provides for ice gripping attachments that are worn on a person's footwear to help the person avoid slipping on an icy surface. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following

What is claimed is:

1. An ice gripping footwear attachment comprising:

a generally flat base that includes an upper surface for engaging the sole of a wearer's footwear and a lower surface carrying grit material that is frictionally engagable with an underlying icy walking surface;

a forward fastening strap attached to a forward portion of said base and extending transversely to and outwardly from opposite sides of said base;

an intermediate fastening strap extending transversely to and outwardly from the opposite sides of an intermediate section of said base, each of said forward and intermediate fastening straps including first and second parts that extend respectively from said opposite sides of said base, said first and second parts of each strap carrying respective, complementary releasable connectors; said first and second parts of each said strap being wrappable across an upper surface of the wearer's footwear and said complementary connectors being selectively interengaged to secure said strap to the footwear and disengaged to release the strap from the footwear, said first and second parts of said forward fastening strap being respectively wrappable across the footwear of the wearer to extend generally rearwardly from said forward portion of said base and cross one another to form an x-shaped pattern across the footwear, one of said forward and intermediate fastening straps being wrapped over the other of said forward and intermediate fastening straps when said first and second parts of each of said forward and intermediate fastening straps are interengaged; and a rearward ankle engaging strap carried by a rearward portion of said base for releasably engaging the wearer's ankle; said forward and intermediate straps being fastened to the wearer's footwear and said ankle engaging strap being engaged with the wearer's ankle to securely attach the ice gripping attachment to the footwear whereby said grit material on the lower surface of said base is frictionally engagable with ice on an underlying walking surface.

2. The attachment of claim 1 in which said intermediate portion of said base has substantially parallel opposite sides and said intermediate fastening strap is secured to said intermediate portion of said base such that when said intermediate fastening strap is wrapped across the wearer's footwear, said first and second parts of said intermediate fastening strap encircle the footwear in a substantially cylindrical configuration.

3. The attachment of claim 1 in which said intermediate fastening strap is wrapped across and interengages said crossing parts of said forward fastening strap when said parts of said intermediate fastening strap are interengaged with one another.

4. The attachment of claim 1 in which at least one of said straps is joined to said base by at least one of adhesive, grommets or rivets.

5. The attachment of claim 1 in which the rearward portion of the base includes a horizontal part for engaging a bottom of the heel of the wearer's footwear and a vertical part attached to and extending upwardly from said horizontal part for engaging the back of the footwear.

6. The attachment of claim 5 in which said horizontal and vertical parts are interconnected along a transverse fold line.

7. The attachment of claim 5 in which said vertical part of said rearward portion of said base includes a heel engaging piece for extending exteriorly across the back of the wearer's footwear.

8. The attachment of claim 7 in which said vertical part includes an opening for accommodating at least a portion of the heel of the wearer's footwear.

9. The attachment of claim 8 in which said opening is generally gable-shaped.

10. The attachment of claim 1 in which substantially the entire bottom surface of said base carries said grit material.

11. The attachment of claim 5 in which the bottom surface of said horizontal and vertical parts of said rearward portion of said base carries said grit material.

12. The attachment of claim 1 in which said rearward fastening strap includes a first segment that extends from one side of said vertical part of said rearward portion of said base and a second segment that extends from the other side of said vertical part, each segment including a complementary connector such that by wrapping said first and second segments about the wearer's ankle and interengaging said complementary rearward fastening strap connectors, said rearward fastening strap is releasably connected to an ankle of the wearer.

13. The attachment of claim 12 in which said rearward fastening strap includes notches that are interengaged with complementary holes in said rearward portion of said base for holding said rearward fastening strap longitudinally in place so that it does not longitudinally slide relative to said rearward portion of said base.

14. The attachment of claim 1 in which said rearward fastening strap includes a pair of first and second strap segments that are longitudinally juxtaposed in a side-by-side manner and extend rearwardly from a rearward end of said base.

15. The attachment of claim 14 in which said juxtaposed strap segments are fastened to said rearward portion of said base by at least one of adhesive, rivets or grommets.

16. The attachment of claim 1 in which said grit material includes at least one of zirconia and ceramic.

17. The attachment of claim 1 in which at least one of said complementary releasable connectors includes hook and loop material.

18. The attachment of claim 1 in which said forward portion of said base includes a pair of opposing side edges that diverge rearwardly along said base, said first and second parts of said forward fastening strap being respectively attached to said diverging side edges of said forward portion of said base.

19. An ice gripping footwear attachment comprising:

a generally flat base that includes an upper surface for engaging the sole of a wearer's footwear and a lower surface carrying grit material that is frictionally engagable with an underlying icy walking surface;

a forward fastening strap attached to a forward portion of said base and extending transversely to and outwardly from opposite sides of said base;

an intermediate fastening strap extending transversely to and outwardly from the opposite sides of an intermediate section of said base, each of said forward and intermediate fastening straps including first and second parts that extend respectively from said opposite sides of said base, said first and second parts of each strap respectively carrying complementary releasable connectors; said first and second parts of each said strap being wrappable across an upper surface of the wearer's footwear and said complementary connectors being interengagable to secure said strap to the footwear; and an ankle engaging connector carried by said base for releasably engaging the wearer's ankle; said forward and intermediate straps being fastened to the wearer's footwear and said ankle engaging connector being engaged with the wearer's ankle to securely attach the ice gripping attachment to the footwear whereby said grit material on the lower surface of said base is frictionally engagable with ice on an underlying walking surface, said angle engaging connector including a rearward fastening strap that extends transversely to and outwardly from opposite sides of said rearward portion of said base, said rearward fastening strap including a first segment that extends from one side of said vertical part of said rearward portion of said base and a second segment that extends from the other side of said vertical part, each segment including a complementary releasable rearward connector such that by wrapping said first and second segments about the wearer's ankle and interengaging said complementary rearward connectors, said rearward fastening strap is releasably connected to an ankle of the wearer, said rearward fastening strap including notches that are interengaged with complementary holes in said rearward portion of said base for holding said rearward fastening strap longitudinally in place so that it does not longitudinally slide relative to said rearward portion of said base.

* * * * *